US009120103B2

(12) United States Patent
Amornpimol

(10) Patent No.: US 9,120,103 B2
(45) Date of Patent: Sep. 1, 2015

(54) CHIPPING OR GRINDING DEVICE AND METHOD OF MANUFACTURING THE SAME

(71) Applicant: Sumate Amornpimol, Prathumthani (TH)

(72) Inventor: Sumate Amornpimol, Prathumthani (TH)

( * ) Notice: Subject to any disclaimer, the term of this patent is extended or adjusted under 35 U.S.C. 154(b) by 12 days.

(21) Appl. No.: 13/793,571

(22) Filed: Mar. 11, 2013

(65) Prior Publication Data

US 2014/0252150 A1 Sep. 11, 2014

(51) Int. Cl.
*B02C 18/16* (2006.01)
*B02C 21/02* (2006.01)
*B02C 18/14* (2006.01)

(52) U.S. Cl.
CPC ..... *B02C 21/02* (2013.01); *B02C 18/143* (2013.01); *Y10T 29/49826* (2015.01)

(58) Field of Classification Search
CPC ..... B02C 18/16; B02C 21/02; B02C 18/18; B02C 18/143
USPC ..... 241/92, 296, 298
See application file for complete search history.

(56) References Cited

U.S. PATENT DOCUMENTS

| | | | | | |
|---|---|---|---|---|---|
| 257,731 | A | * | 5/1882 | Lynn et al. | 241/101.4 |
| 2,565,226 | A | * | 8/1951 | Gross, Jr. | 241/92 |
| 3,144,995 | A | * | 8/1964 | Fontaine | 241/298 |
| 3,286,745 | A | * | 11/1966 | Meis | 144/178 |
| 3,332,461 | A | * | 7/1967 | Ledergerber | 144/176 |
| 4,827,989 | A | * | 5/1989 | Strong | 144/176 |
| 5,080,153 | A | * | 1/1992 | Waterman | 144/176 |
| 5,261,469 | A | * | 11/1993 | Severson | 144/176 |
| 5,762,122 | A | * | 6/1998 | Rice, Sr. | 144/373 |
| 7,798,436 | B2 | * | 9/2010 | Cornelius | 241/55 |

* cited by examiner

*Primary Examiner* — Faye Francis
(74) *Attorney, Agent, or Firm* — Andrew D. Fortney; Central California IP Group, P.C.

(57) ABSTRACT

A grinding or chipping device and a method of manufacturing the same is disclosed. A chipping or grinding device generally includes a base having a plurality of U-shaped, I-shaped, or C-shaped metal plates and/or beams, an engine on the base, the engine transmitting drive power to a blade plate at a back portion of the base, and a cover over the blade plate. The chipping or grinding machine advantageously provides improved operation by minimizing and/or eliminating chipped or ground pieces and/or material from becoming stuck or jammed in the device.

10 Claims, 4 Drawing Sheets

CHIPPING OR GRINDING DEVICE AND METHOD OF MANUFACTURING THE SAME

FIELD OF THE INVENTION

The present invention generally relates to the field of mechanical engineering. More specifically, embodiments of the present invention pertain to a chipping and/or grinding device and/or machine and methods thereof.

DISCUSSION OF THE BACKGROUND

Generally, chipping or grinding machines include a blade plate in which both sides are connected to an axle. The blade plate is installed at a front side of a machine base. The blade plate is notched with one open-side slit, on which the blade is installed on an upper side. The sharp side of the blade turns to the open-slit side. Positioned above the blade plate is a cover that functions as an entrance for the spill (e.g., the chipped or ground material). An exit channel for the processed spill is under the cover. The structure of conventional machines may not operate as efficiently as it should because the blade placement may not be sufficiently uplifted or spaced apart from the blade plate. Furthermore, conventional chippers or grinders having the axle on both sides of the blade plate may cause the spill (e.g., chipped material) to become stuck on the blade placement side during the operation.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to a chipping and/or grinding device and/or machine having improved performance that overcomes the above-mentioned shortcomings in conventional chipping or grinding machines. To implement the objective(s) of the present invention, technical proposals are provided below.

In one aspect of the present invention, the chipping or grinding device has a base, a front and/or middle portion of which is the location of an engine (mounted on the base). The engine transmits mechanical power through an axle, which is connected to a blade plate. The blade plate is installed at the back of the machine base, and the axle is connected to one side of the plate. The plate is notched for two or more one-side-open slits, which may be angled. One of the plate sides is made or adapted for the blade placement. Each blade edge is sloped since the open-edge side is beyond the plate center. Once each blade is affixed or secured to its placement location, the sharp side (i.e., the edge) must be uplifted or spaced away from the plate, and the blade length should be greater than the radius of the plate (i.e., the distance from the outer peripheral surface of the plate to the plate center). When the blades are installed, the sharp sides generally face towards each other.

Thus, the chipping or grinding machine of the present invention advantageously provides improved operation by minimizing and/or eliminating spill pieces and/or chipped or ground material from getting stuck or jammed in the device. Material to be chipped or ground includes, but is not limited to, wood (e.g., trees, boards, etc.), plastic (e.g., polyethylene, polypropylene, polystyrene, or combinations thereof), paper, paperboard, etc. In addition, a plate and/or cover is advantageously installed and/or fitted above the plate as an entrance for the spill material, and an exit channel of the processed spill is advantageously located at the side of the cover.

In another aspect of the present invention, the blade placement is sloped since the open-edge side is beyond the plate center. In installing the blade, the sharp side of each blade should be uplifted or spaced away from the plate, and the sharp sides of the blades generally face each other once mounted on the blade placement. The length of each blade may be greater than the radius of the plate (i.e., the distance from the outer peripheral surface of the plate to the plate center) in order to provide better operation during the grinding or chipping work.

These and other advantages of the present invention will become readily apparent from the detailed description of various embodiments below.

DETAILED DESCRIPTION

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

Figure 1:
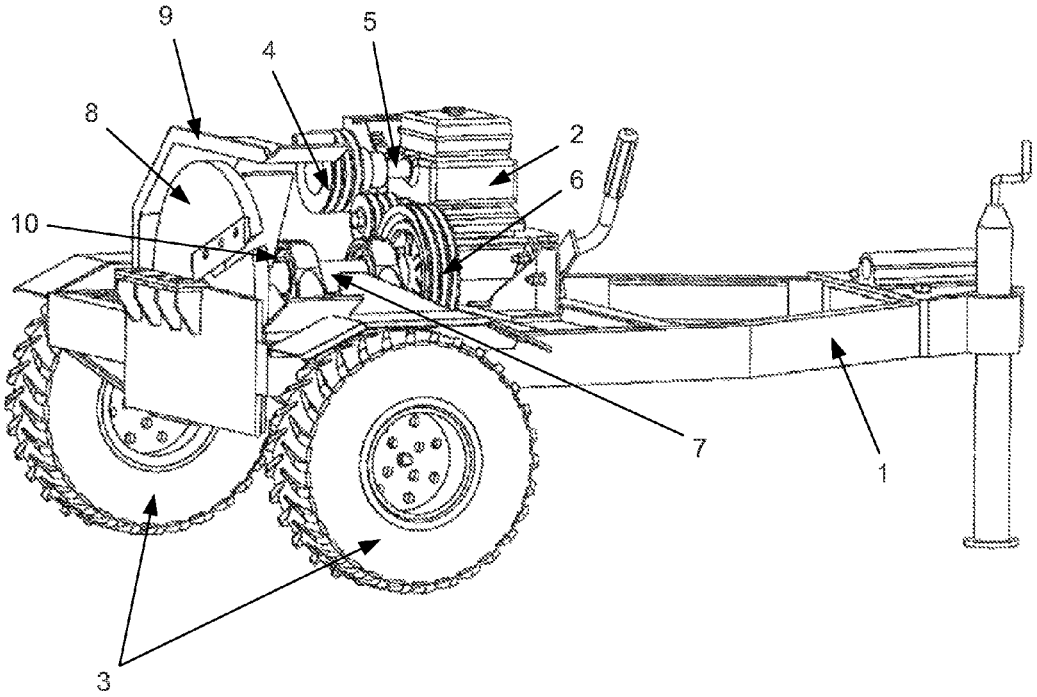
FIG. 1 is a diagram showing a chipping or grinding device according to the present invention.

For the sake of convenience and simplicity, the terms "device," "machine," and "apparatus" are generally used interchangeably herein, but are generally given their art-recognized meanings Also, for convenience and simplicity, the terms "connected to," "coupled with," "coupled to," and "in communication with" may be used interchangeably, but these terms are also generally given their art-recognized meanings According to FIG. 1, the chipping or grinding device and/or machine of the present invention comprises a base 1, which may comprise or be made of a plurality of C-shaped, I-shaped, and/or U-shaped metal plates and/or beams. The base 1 includes a front side, on which the engine 2 is placed, mounted and/or located. At a back side and/or portion, and beneath the base 1, two or more wheels 3 are installed on the left and the right sides of the base 1. The engine 2 may be electric and/or gasoline powered, and transmits the driving power to a first pulley wheel 4 which is installed with a drive shaft 5 connected to the engine 2. Although the pulley-based system in FIG. 1 is based on a belt and wheels, other mechanical energy transfer systems (e.g., a chain and sprockets for multiple speeds, multiple gears, etc.) are also contemplated for use in the present invention. The drive shaft may rotate at a speed of 50-1000 rpm (or any range therein), for example. Power is driven through a belt or chain (not shown) for mechanical energy transmission to a second pulley wheel 6, which is connected to an axle 7 of the blade plate 8. The second pulley wheel 6 may have a greater or smaller diameter than the first pulley wheel 4. At a front portion of the base 1, the blade plate 8 is installed above the wheels 3 or between the wheels 3 and engine 2. The blade plate 8 is vertically below a cover 9. Cover 9 is located on the base 1 and may have vertical sides to keep chipped material from flying into the engine 2.

In various embodiments of the present invention, on one side of the blade plate 8 is the axle 7 handled or guided by two bearings 10. Axle 7 may rotate at 100-5000 rpm (or any rate or range of rates therein), for example. The two bearings 10 are installed on the base 1. At the front of the cover 9, a shield (not shown) is installed, which may form the entrance for spill material (e.g., spill pieces or material to chipped or ground, such as trees, shrubs, brush, boards, paper, paperboard, plastic [for recycling], etc.). Processed spill material is released through the exit at the side of the cover 9. Alternatively, processed spill may be captured in a container (not shown).

Figure 2:
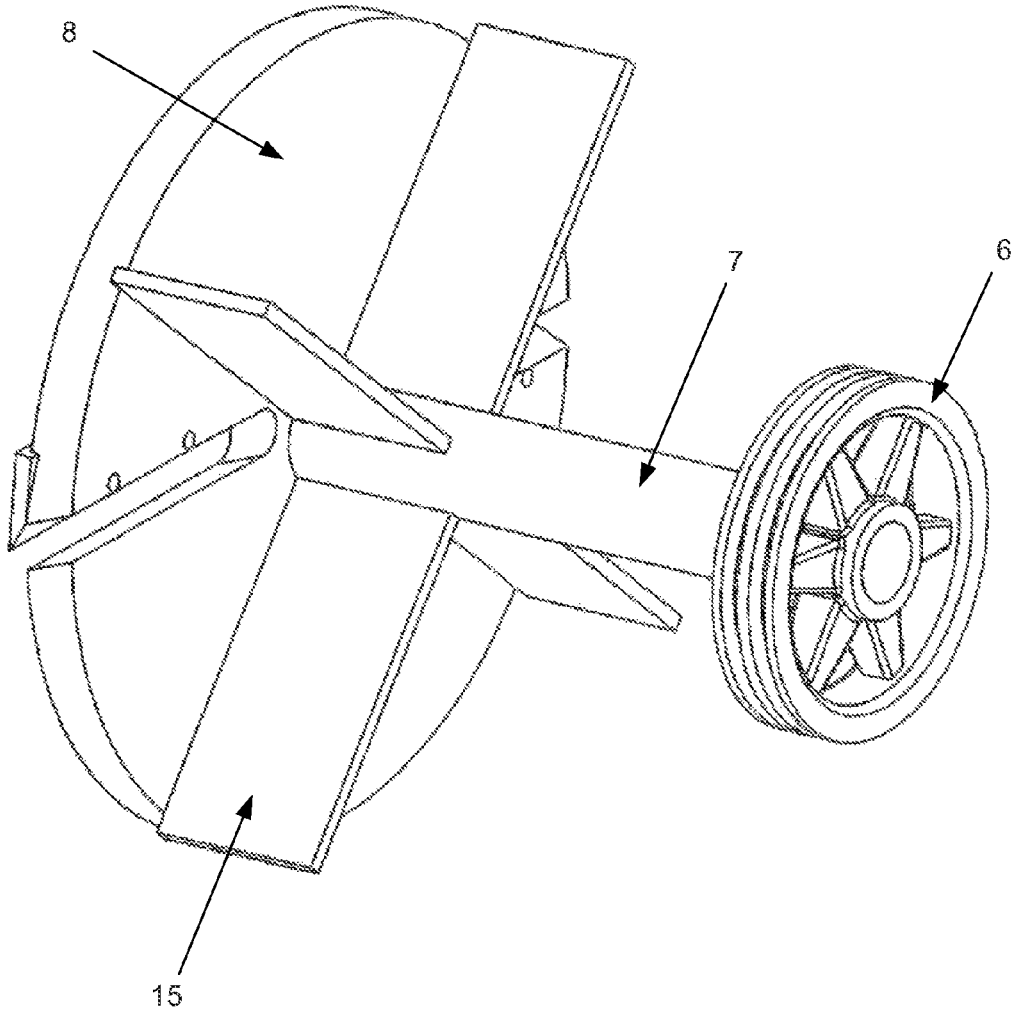
FIG. 2 is a diagram showing an exemplary blade plate of the chipping or grinding device according to the present invention.

According to FIG. 2, a center of the blade plate 8 is connected to one end of the axle 7. The other end of axle 7 is connected to the second pulley wheel 6, which receives the drive power from the first pulley wheel 4 fixed to the drive shaft 5. The drive shaft 5 is driven by the engine 2. The blade plate 8, which is connected to the axle 7, has a number of metal plates 15 attached. The number of plates 15 corresponds to the number of slits in the blade plate 8 (e.g., 1 or 2 metal plates 15 for each slit in the blade plate 8). Thus, the embodiment in FIG. 2 includes 4 metal plates 15. Plates 15 may be flat and have a width of, e.g., 10-35 cm (or any width or range of widths therein). The axle 7 drives the blade plate 8, and thus, the metal plates 15 may form propellers. Having the length of the metal plates 15 extend slightly beyond the blade plate 8 (e.g., by 1-10% of the radius of the blade plate, or any value or range of values therein) provides more wind power to push away the processed chipped or spill pieces through the exit channel at the side of the base 1 more powerfully and more quickly.

Figure 3:
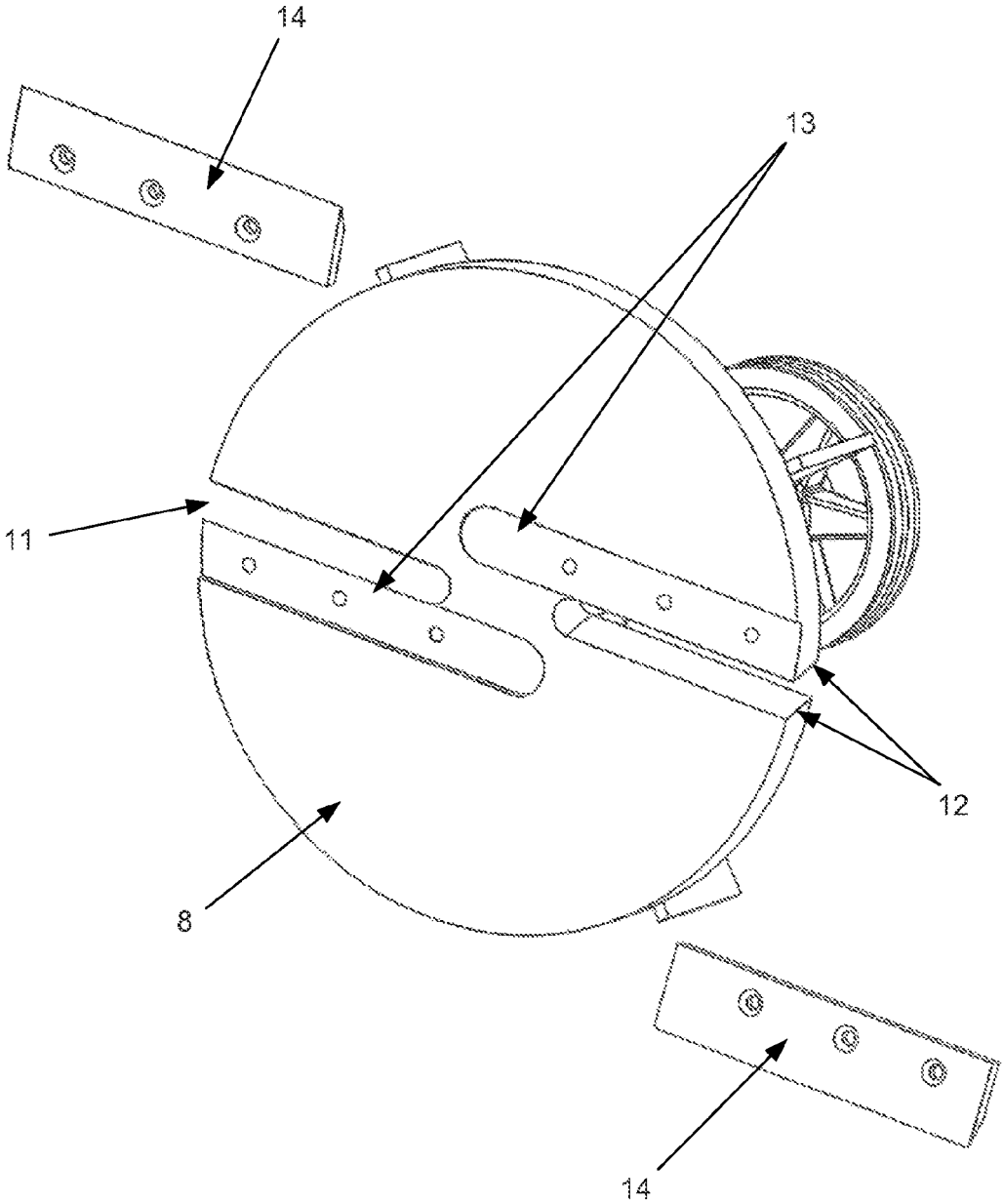
FIG. 3 is a diagram showing another side of the blade plate of the chipping or grinding device according to the present invention.

According to FIG. 3, the other side of the blade plate 8 without the axle 7 is notched for two open-end slits 11 on the left and the right of the blade plate 8. However, blade plate 8 may have more than 2 slits, and the slits 11 are not necessary open-ended (i.e., open at the peripheral edge of the blade plate 8). Both slit edges 12 of the slits 11 are sharpened and/or angled. The upper side of the slits 11 (i.e., the edge of the slit 11 away from the direction of rotation of the blade plate 8) is made for the blade placement 13, which is sloped from the edge beyond the center of the blade plate 8 (see, e.g., FIG. 4) in order to have the sharp side of the blade 14 uplifted on the blade placements 13 or spaced away from the blade plate 8. The blade placements 13 may comprise a recess (e.g., 0.5-1 cm) into the blade plate 8, and a plurality of drilled holes in the blade plate 8 for a blade fastening mechanism (e.g., screw, bolt-and-nut assembly, etc.). When the blades 14 are installed on the blade placements 13 of the blade plate 8, the sharp sides of the blades 14 will be spaced equally and next to each other, enabling quicker chipping and/or grinding of the spill material. The blades 14 may have an edge having a 10-45° angle that faces towards the slits 11. The blade edge can be curved (e.g., concave), serrated, saw-toothed, or straight.

Figure 4:
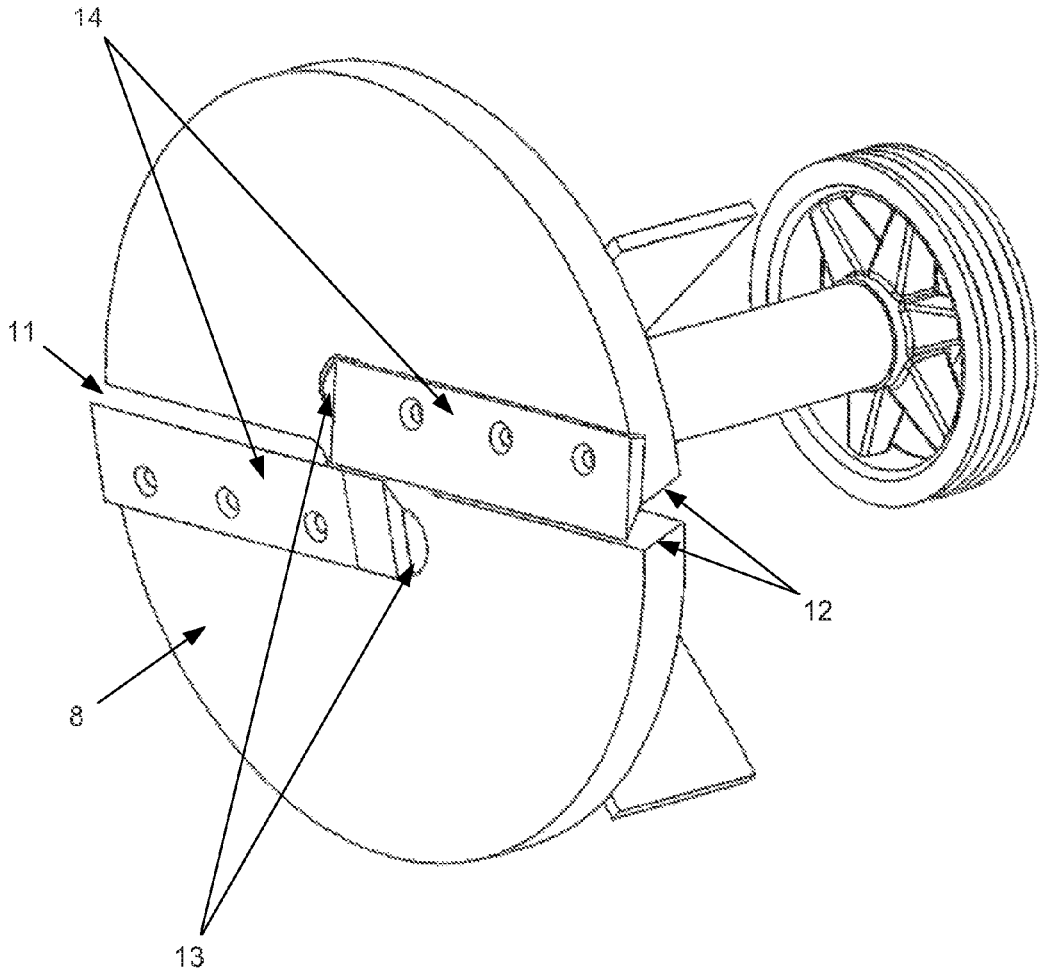
FIG. 4 is a diagram showing the blade plate and a blade according to the present invention.

According to FIG. 4, the blade plate 8 is notched for open-end slits 11 on opposed sides (e.g., on the left and the right) of the blade plate 8. The blade plate 8 may have a diameter of 20-100 cm (or any range therein) and a thickness of 2-5 cm (or any range therein). On the blade plate 8, both sides of the slit edges 12 of the open-end slit 11 are angled and/or sharpened. The angle of the slit 11 may be from 60° to 88° (or any angle or range of angles therein). The upper side of the blade plate 8 adjacent to the slit 11 is made for the blade placement 13. The slit 11 may be cut as a slope, since the edge of the slit 11 goes to the center of the blade plate 8. When each of the blades 14 is installed on the respective blade placement 13, the length of the blade 14 will reach beyond the center of the blade plate 8. The blades 14 may have a length about equal to the radius of the blade plate 8 ±5-10%, and a width of about 2-10 cm (or any width or range of widths therein). In addition, the sharp side of each blade 14 in an opposed pair of blades will be next to and/or adjacent to each other.

The blades 14 may comprise stainless steel, tempered steel, tempered aluminum or aluminum alloy, brass, etc. A plurality of fastening devices (e.g., screws, rivets, nut-and-bolt assemblies, etc.) attaching the blades 14 to the blade placement 13 and/or the blade plate 8 may be 2, 3, 4, or more. In a further or alternative embodiment, the blade placement 13 may comprise a metal plate of the same or different metal as the blade 14, having a thickness of 1-5 cm (or any range therein) with pre-drilled holes for the blade attachment mechanism.

CONCLUSION/SUMMARY

Thus, the present invention provides a chipping or grinding device and method(s) of manufacturing the same. The chipping or grinding device has a base, a front and/or middle portion of which is the location of and support an engine. The engine transmits the power through an axle, which is connected to a blade plate. The blade plate is installed at the back of the machine base, and the axle is connected to one side of the plate. The plate is notched for two or more slits (e.g., along a radius of the blade plate 8) that may be open at a peripheral edge of the blade plate), in which both sides are angled or sharpened, and one side is adapted for the blade placement. Each blade placement is sloped since the open-edge side maybe beyond the plate center. Once each blade is on its placement, the sharp edge of the blade is uplifted or spaced away from the plate, and the blade length extends beyond the plate center. When both blades are installed, the edges of the sharp sides generally face each other.

Thus, the present chipping or grinding device advantageously improves operational performance. The chipping or grinding machine of the present invention advantageously provides improved operation of the device by minimizing and/or eliminating spill pieces and/or material to be chipped or ground from getting stuck or jammed in the device. In addition, a plate cover is advantageously installed above the plate, and it functions as an entrance for the material to be chipped, and an exit channel for the processed spill or chipped material is advantageously located at a side of the cover.

The foregoing descriptions of specific embodiments of the present invention have been presented for purposes of illustration and description. They are not intended to be exhaustive or to limit the invention to the precise forms disclosed, and obviously many modifications and variations are possible in light of the above teachings. The embodiment(s) were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A chipping and/or grinding device comprising:

a base having a plurality of metal plates and/or beams;

an engine on said base and a drive shaft operably connected to said engine, said engine transmitting a drive power to said drive shaft;

a blade plate having (i) two or more blades extending beyond a center of said blade plate and having an angled edge next to or adjacent to the angled edge of an adjacent blade, and (ii) two or more angled slits, the blade plate at a back portion of said base;

an exit channel at a side portion of said grinding machine, said exit channel configured to remove said chipped or ground material;

metal plates located on a back portion of said blade plate, said metal plates extending beyond said blade plate and being configured to propel or push chipped or ground material towards said exit channel;

a mechanism that transfers said drive power from said drive shaft directly or indirectly to said blade plate; and a cover over said blade plate configured to prevent chipped or ground material from entering the engine.

2. The grinding device of claim 1, wherein said blade plate is vertically located below said cover, said cover being installed on or over said machine base.

3. The grinding device of claim 1, further comprising an axle to which said blade plate is fastened or affixed, and a pulley between said drive shaft and said axle.

4. The grinding device of claim 3, wherein said blade plate has a first side having a center connected to said axle.

5. The grinding device of claim 1, wherein said slits are open at a peripheral edge of said blade plate, and said slits are along a radius of said blade plate.

6. The grinding device of claim 1, wherein said slit edges are angled at an angle of from 60° to 88° relative to a face of said blade plate.

7. The grinding device of claim 6, wherein each of said blades share an edge facing towards a respective one of said slit.

8. The grinding device of claim 1, further comprising a blade placement on said blade plate for each of said two or more blades, adjacent to a respective one of said slits.

9. The grinding device of claim 8, wherein said blade placement has a slope.

10. The grinding device of claim 1, wherein said blades are fastened or affixed to said blade placements, said blades each having an edge spaced from said blade plate and facing the edge of another edge blade.

* * * * *